United States Patent [19]

Siegal et al.

[11] Patent Number: 4,765,022

[45] Date of Patent: Aug. 23, 1988

[54] COMBINATION STOP PLUG AND FRAME MEMBER FOR CHANNELLED DRAPERY TRACK

[75] Inventors: Burton L. Siegal, Skokie; John T. Magdars, Northbrook, both of Ill.

[73] Assignee: Coral Industrial Sales Co., Chicago, Ill.

[21] Appl. No.: 30,452

[22] Filed: Mar. 25, 1987

[51] Int. Cl.[4] ..... A47H 15/00

[52] U.S. Cl. ..... 16/87.4 R; 16/93 D; 16/95 D; 16/96 D; 160/345

[58] Field of Search ..... 16/87.2, 87.4 R, 93 D, 16/93 R, 95 D, 96 D, 94 R, 94 D, 86.1, 87 R, 87 B; 160/345, 346

[56] References Cited

U.S. PATENT DOCUMENTS 4,153,969 5/1979 Mergenthaler ..... 160/345
4,584,737 4/1986 Ohman ..... 16/93 D

FOREIGN PATENT DOCUMENTS 2649149 6/1978 Fed. Rep. of Germany ..... 16/96 D
1526549 4/1968 France ..... 16/87 R

*Primary Examiner*—Nicholas P. Godici
*Assistant Examiner*—Edward A. Brown
*Attorney, Agent, or Firm*—Silverman, Cass, Singer & Winburn, Ltd.

[57] ABSTRACT

A combination stop plug and open frame member for installation in the channel of a drapery track. The plug and frame parts are integrally formed. The plug part is sized and configured to be installed by sliding through an open end of the channel and immobilized in the channel by means of an accessible fastener, such as a set screw. The frame part is located exterior of the channel for accomodating therethrough a drapery fastener holder of a drapery carrier member slidable in the channel. However, the frame part prevents movement of the carrier member by engaging the fastener holder part extending therethrough. The device of the invention can be installed to close the open end of the channel with the fastener holder part located to hold a portion of the drapery panel overlying the open end of the channel.

7 Claims, 1 Drawing Sheet

FIG. 1
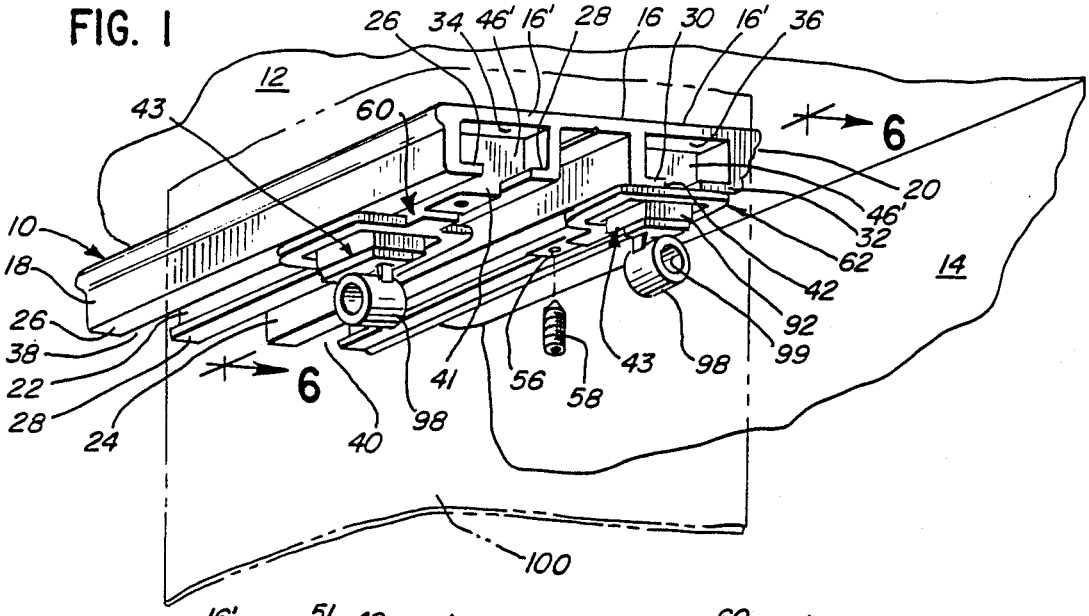
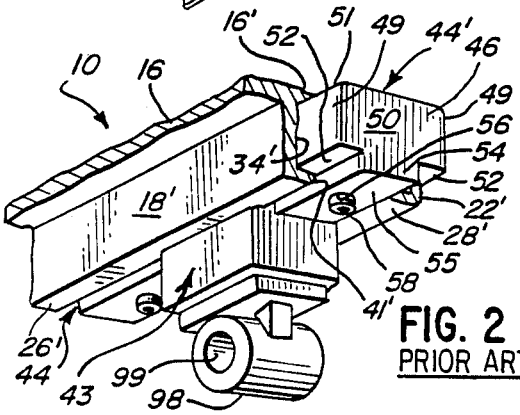
FIG. 2
PRIOR ART
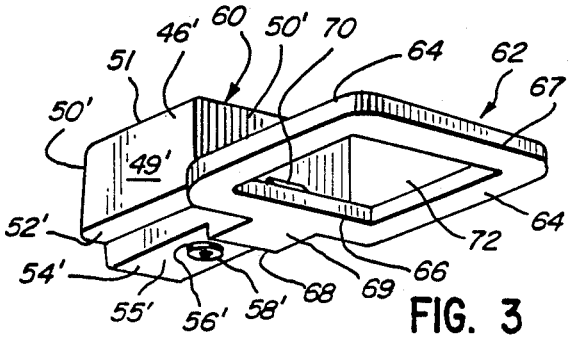
FIG. 3
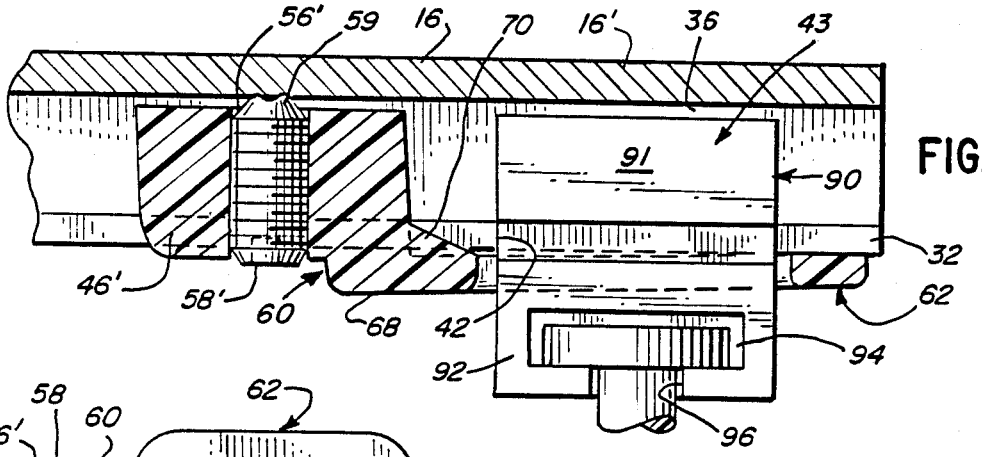
FIG. 6
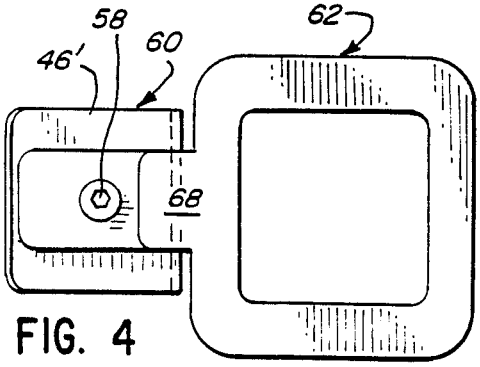
FIG. 4
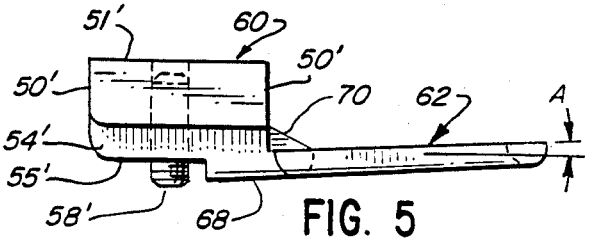
FIG. 5

COMBINATION STOP PLUG AND FRAME MEMBER FOR CHANNELLED DRAPERY TRACK

BACKGROUND OF THE INVENTION

This invention relates generally to drapery support or track systems having drapery carrier members slidably engaged within the channels thereof. More particularly, the invention relates to a novel combination stop plug and frame member for a drapery carrier member, the stop plug capable of being removably installed in a track at varying locations including a position to close an open end of the track with a carrier member immobilized by the frame member.

Drapery track systems may include single or multiple elongate, open-ended channel formations in which drapery carrier members are slidable along the length thereof. The carrier members are inserted in the channel formations through said open ends and include means for installing the fasteners from which engaged drapery panels are suspended, such as pins, hooks or snaps, as the case may be. It is necessary to close off the open ends of the channels once the individual carrier members have been inserted so as to prevent them from sliding out of the channel inadvertently after the drapery panels are installed.

End plugs were available for insertion into open ends of such channels. These consisted of molded plastic bodies which were wedged into the channel's open end after the carriers were in place. Such plugs were difficult to withdraw from the channel when repairs were required of the carriers which were strung together for opening and closing a drapery panel suspended therefrom. Such end plugs were not suitable for installation in the channel spaced remote from an open end.

End caps also were used for closing off the end of a channel. Such end caps would have means for attaching a hook or fastener on a drapery panel end so that the panel end could be wrapped around the end cap to hide it from view.

A stop plug of the prior art and detailed in the specification comprised a molded body dimensioned to be slidably inserted into a channel through an open end and fixed in place by means of a set screw which when tightened, wedged the end plug in place in the channel. However, such end plugs had no cooperative engagement with the carrier members. If desired to position a carrier member against movement in a channel, a pair of such end plugs was required with the carrier member sandwiched therebetween.

The invention provides a stop plug which has an open rectilinear frame integral with and extending laterally therefrom. The frame is constructed and dimensioned to immobilize a carrier member having a drapery fastening holder which will depend downwardly for receiving a drapery fastener, hook or the like. The stop plug includes a set screw accessible from outside the track channel in which the plug is slidably installed. The stop plug can be installed to function as an end plug for a track channel or can be installed remote from an open end of the channel to immobilize a carrier member extending through the frame of the stop plug.

SUMMARY OF THE INVENTION

A combination stop plug and frame member for a channeled drapery track. The channel has at least one open end for inserting drapery carrier members to be slidable therein. The plug is sized and configured to be slidably inserted through the open end of the channel and includes means accessible from exterior of the channel for releasably locking said stop plug in said channel at any selected location therealong. The frame is integral with said stop plug and includes an open rectilinear formation for receiving therethrough a holder part of the carrier member to which a drapery fastener can be attached next adjacent said stop plug. The plug can be installed to close an open end of the channel with said carrier member advantageously positioned to enable a drapery panel to be folded around a track end to overlie the stop plug. The combination stop plug and frame can be installed in a channel remote from an end of the channel for immobilizing a carrier member at a selected position in the channel.

BRIEF DESCRIPTION OF THE DRAWING

FIG. 1 is a fragmentary perspective view of a dual channel drapery track having the stop plug embodying the invention installed in each channel and supporting a carrier member in differing orientation.

FIG. 2 is a fragmentary perspective view of a drapery track showing prior art stop plugs installed in the channel thereof and a separate carrier member sandwiched therebetween.

FIG. 3 is a perspective view of the stop plug embodying the invention.

FIG. 4 is a plan view of the stop plug embodying the invention.

FIG. 5 is a side elevational view of the said stop plug of FIG. 3.

FIG. 6 is a sectional view taken along the line 6—6 of FIG. 1 and in the general direction indicated.

DESCRIPTION OF PREFERRED EMBODIMENT

Referring now to FIG. 1, there is illustrated a conventional dual channel drapery track 10, preferably formed as an elongate, aluminum extrusion and shown installed on a ceiling 12 at a location adjacent a side wall 14 of a room. The track 10 has a transverse wall 16 and depending, parallel side walls 18 and 20 at opposite extremities of the wall 16. Spaced inward from the side walls 18 and 20 are similar parallel depending walls 22 and 24. Said depending walls 18, 20, 22 and 24 have right angle end flanges 26, 28, 30 and 32 respectively. Walls 18 and 22 define a channel 34 therebetween and walls 20 and 24 define a second channel 36 therebetween. The channels 34 and 36 extend the entire length of the track 10 and are in parallel relationship to each other. Flanges 26 and 28 oppose each other to form a narrow gap or mouth 38 into the channel 34. Flanges 30 and 32 oppose each other to form the narrow gap or mouth 40 into channel 36. Each channel 34 and 36 has a segment 16' of wall 16 opposite a gap or mouth thereof. The open ends of the channels 34 and 36 are designated 41 and 42 respectively.

In the conventional drapery track system a multiplicity of carrier members, such as members 43, are strung together and installed in the track channels 34 and 36. The carrier members are designed to slide on the flanges or ledges of a track channel and carry a suitable hook or pin from which the drapery panel is suspended. For purposes of this invention, draw strings will be provided for opening and closing the drapery panels or draw rods may be used for this purpose, depending on the nature of the drapery panel installation involved.

Referring to FIG. 2, for purposes of illustration, there is shown a single channel track in which a prior art stop plug 44 is featured. The single channel 34' corresponds to the channel 34 and hence the same reference characters used to describe elements of channel 34 will be used to describe those of channel 34' although they will be primed (′). The channel 34' has an open end 41' into which a stop plug designated 44 is mounted. Adjacent plug 44 is a carrier member 43 supported on the ledges or flanges 26' and 28' and sandwiched between another end plug 44' to immoblize the carrier 43. Thus, two plugs 44 and 44' would be used to fix a carrier 43 in a designed position. Of course, the plug 44 could be installed as an end plug to close the open end of the channel 34'.

The plug 44 is formed as a solid, preferably synthetic plastic molded body 46 of generally rectilinear configuration. Body 46 has parallel side walls 49, parallel bridging end walls 50 and top wall 51. The opposite bottom end of plug 44 is undercut to provide a pair of shoulders 52 on opposite sides of the depending island formation 54. The distance between top wall 51 and a shoulder 52 is less than the distance between a ledge or flange 26', 28' and the bridging portion 16' of the channel. The thickness of formation 54 is slightly less than the width of the gap 38' between the flanges. Thus, the plug 44 can be inserted through open end 41' of the channel 34' with shoulders 52 riding on the flanges 26', 28' and formation 54 extending downwardly through the gap 38'. The bottom face of the formation 54 is designated 55.

Extending from face 55 to top wall 51 is a medial threaded bore 56 for accommodating a set screw 58. The set screw 58 is sufficiently long to be accessible from bottom face 55 for tightening it. When so tightened, the set screw 58 has an opposite end 59 which can be engaged against the portion 16' so that the shoulders 52 will be biased against flanges 26', 28' thereby fixing the plug in that set position in the channel 34'.

Referring to FIGS. 3, 4 and 5, the combination stop plug and frame member embodying the invention is designated generally 60. The member 60 is an integral molded member comprised of a solid body part 46' and a frame part 62 extending longitudinally from the body part 46'. The body part 46' is substantially identical in configuration and formation to the body 46. The set screw 58' in bore 56' in body part 46' is to be noted also. In the FIGURES, like components are identified using primed (′) designators for purposes of simplification.

The frame part 62 is comprised of an open rectangular part defined by opposing sides 64 and opposing sides 66 and 67. The frame part 62 is attached to the island formation 54' by means of the connecting tongue 68. The tongue 68 actually comprises an extension of the formation 54'. However, tongue 68 has its bottom face 69 protruding below face 55' of formation 54' so that the frame part 62 also is oriented in a plane below the solid body part 46'. Thus, as seen in the FIGURES, the frame part 62 extends forwardly from the end wall 50' and is braced additionally by the brace 70. The rectilinear size of the opening 72 of frame part 62 is selected to permit passage of a carrier member part, as will be described. As seen in FIG. 5, the frame part 62 extends forwardly from end wall 50' at an upwardly canted angle A.

Referring to FIGS. 1 and 6, the installation of the stop plug and support frame 60 of the invention shall be described. Stop plug and mounting frame 60 is illustrated as installed within channel 36 in condition to support and to anchor carrier member 43 depending from the mouth 40 of the channel and also closing off the open end 42 of said channel 36. The carrier member 43 is a conventional structure. It includes a solid rectangular body 90 slotted on a pair of opposite sides 91 for receiving end flanges 30 and 32 and is slidable therealong. Body 90 has a part 92 depending therefrom to exterior of channel 36 through gap 40 which carries a channel formation 94. Channel 94 has a slot 96 through which a fastener hanger cylinder 98 is rotatably installed in channel 94. Cylinder 98 terminates in an open end 99 through which a conventional drapery panel hook can be engaged for attachment to the upper edge of the panel 100 seen in FIG. 1.

It will be appreciated that the carrier 43 can take any of numerous conventional forms. For instance, carrier 43 can be of the type providing snap fasteners or just a simple depending ring. All of these will be suitable for installation in a drapery track channel and be suitable for cooperative engagement with the frame member of device 60 with attendant advantage derived from the invention.

The stop plug and frame 60 is illustrated as installed within channel 34 in condition to fix a carrier 43 at any location within channel spaced from the open end 41 thereof. The carrier 43 which depends from channel 34 is illustrated with the axis of its hanger cylinder 98 oriented 90° relative to the length of the channel 34. However, hanger cylinder 98 depending from the carrier 43 illustrated in channel 36 is oriented in a direction parallel to the length of channel 36 and adjacent the open end 42.

The frame part 62 of the combination stop plug and support frame 60 has been described, in a preferred embodiment, as canted upwardly. The cant is provided by wall 68 of body 46' so that when the set screw 58' is taken up to wedge the body 46' against the adjacent flanges of a channel, the frame part 62 is caused to flex against the bottom surfaces of adjacent flanges so that the frame part does not flare away from the channel flanges. This results in the cylinder 90 staying squared up with the channel instead of canting outwardly therefrom. Frame part 62 remains attractively wedged against the bottom surfaces of the flanges 30 and 32.

Referring to FIG. 1, it is important to note that the device 60 enables the holder cylinder 98 or a ring 90 to be located in a plurality of different sites relative to an open end of a channel. Also, the axis of the holder 90 can be adjusted to be normal to or parallel to the length of a channel. When the device 60 is installed to close an open end of a channel, such as shown installed in channel 36, the holder cylinder 98 is oriented parallel to the channel's length and slightly protruding beyond the open end 42. In this position, the end of a drapery panel can be tracked around the ends of the channels and fastened to the holder cylinder 98 so as to cover and mask the open ends of the track channels. This eliminates the need for a separate end cap for this purpose. The versatility of installations of device 60 is readily appreciated from this advantage derived from device 60.

Further, the frame part 62 immobilizes the hanger holder 98 extending therethrough. This function would be achieved with any of the prior art carrier members installed in a track channel.

The invention is capable of variation in structure, arrangement and size of the component parts without departing from the spirit and scope thereof as defined in the appended claims.

We claim:

1. An integral stop plug and support frame member for installation in the channel of a drapery track, the channel being open at an end thereof and having a pair of opposing flanges spaced apart to define a gap therebetween, said member comprising a body part and an open frame part, said body part being sized and configured to be insertable into the channel through said open end and thereafter slidable on said flanges along the length of the channel, said body part having a depending island formation adapted to extend outwardly of the channel through said gap when the member is installed in the channel, said depending island formation defining shoulder means for sliding engagement on the flanges, said frame part extending from said island formation in spaced relation below said shoulder means and beyond the body part in the direction of the length of the channel and below said flanges for receiving a channel-mounted carrier member segment therethrough while the carrier member is slidably installed in the channel, and means for releasably locking said stop plug and support frame member against movement in said channel at a selected location.

2. The integral member as claimed in claim 1 in which said locking means comprise screw means carried by said body part selectively manipulatable to bear against a segment of the channel for wedging the body part against said flanges whereby simultaneously immobilizing the stop plug and support frame member at a given location with the carrier member segment protruding beyond the support frame.

3. The integral member as claimed in claim 2 in which said frame part is canted inwardly relative to said body part whereby frictionally to engage and flex against the exterior of the channel flanges when the stop plug and support frame member is immobilized.

4. The integral member in claim 1 in which said body part is capable of being positioned adjacent the open end of the channel whereby to close off said end and the frame part is arranged to cooperate with a carrier member for securing a drapery panel overlying the open end of the track channel.

5. A stop plug for a drapery track having an open ended channel capable of receiving drapery carrier members slidably therein, said stop plug comprising a plastic molded body of a size and configuration to be insertable through the open end of the channel and slidable therealong to a selected location, a planar lateral extension integral with said body including an open frame, and means carried by said body capable of selectively locking said stop plug at the selected location with a carrier member within the channel and having a drapery fastener holder part protruding through and retained within said frame, said lateral extension being canted inwardly toward the body of the stop plug and capable of being flexed to bear against the channel when the locking means is tightened to immobilize the stop plug at the selected location.

6. A stop plug for a drapery track having an open ended channel capable of receiving drapery carrier members slidably therein, said stop plug comprising a body of a size and configuration to be insertable through the open end of the channel and slidable therealong to a selected location, support means on said stop plug for releasably fixing a carrier member to the stop plug for slidable movement of the carrier member with the stop plug and for precluding movement of the carrier member relative to the stop plug, and means carried by said body for selectively locking said stop plug at the selected location with the carrier member within the channel said support means comprising a lateral extension on said body, said lateral extension including an open frame for receiving a carrier member therethrough, encircling said carrier member and confining the carrier member completely thereabout for precluding withdrawal of the carrier member laterally from the frame relative to the stop plug body.

7. In a stop plug for a drapery track including an elongate channel with a full length mouth therealong for the extension therethrough of track-mounted sliding drapery holder members, the stop plug including a body slidably receivable within the channel, said body having opposed ends and a projecting portion on the body between said ends for extension through said channel mouth, said projecting portion including an outer face and defining shoulder means inward of said outer face for slidably retaining said stop plug within the channel, and lock means for fixing said stop plug at a selected portion along said channel, the improvement comprising a support frame rigid with said projecting portion in outward spaced relation to said shoulder means for positioning outward of the channel mouth, said support frame generally paralleling said outer face and extending beyond one of said ends, said support frame defining an opening therethrough for receiving a track-mounted drapery holder member therein and fixing said holder member to said stop plug for precluding movement of the holder member relative to the stop plug.

* * * * *